US008109643B2

(12) United States Patent
Wu

(10) Patent No.: US 8,109,643 B2
(45) Date of Patent: Feb. 7, 2012

(54) PERFUME-DISPENSING, AUTO LIGHT-REGULATING AND MUSIC-PLAYING LAMP SYSTEM

(76) Inventor: Tsai-Ying Wu, Zhonghe (TW)

( * ) Notice: Subject to any disclaimer, the term of this patent is extended or adjusted under 35 U.S.C. 154(b) by 513 days.

(21) Appl. No.: 12/370,595

(22) Filed: Feb. 13, 2009

(65) Prior Publication Data

US 2010/0208462 A1 Aug. 19, 2010

(51) Int. Cl.
*F21V 33/00* (2006.01)

(52) U.S. Cl. ..... 362/96; 362/86; 362/253; 362/295

(58) Field of Classification Search ..... 362/85, 362/86, 87, 101, 96, 231, 253, 295, 394
See application file for complete search history.

(56) References Cited

U.S. PATENT DOCUMENTS

| | | | | |
|---|---|---|---|---|
| 5,193,984 | A * | 3/1993 | Lin | 362/96 |
| 5,321,669 | A * | 6/1994 | Thayer et al. | 362/253 |
| 7,476,002 | B2 * | 1/2009 | Wolf et al. | 362/231 |
| 2006/0098440 | A1 * | 5/2006 | Allen | 362/294 |

* cited by examiner

*Primary Examiner* — Y My Quach Lee
(74) *Attorney, Agent, or Firm* — Chun-Ming Shih

(57) ABSTRACT

A perfume-dispensing, auto light-regulating and music-playing lamp system includes a body unit having a lamp mounted in a housing thereof, an aroma dispenser mounted in the body unit, a control panel mounted outside the body unit and having a function selector, a memory setting button and multiple display devices, and a speaker mounted in the body unit for sound/music output. By means of operating the function selector, a user can set on/off time of the lamp to simulate the lighting effect from dim to bright light of sun raise, to set alarm clock, to set on/off time of pre-recorded sound/music, and to set the aroma dispensing time of the aroma dispenser.

10 Claims, 11 Drawing Sheets

79

PERFUME-DISPENSING, AUTO LIGHT-REGULATING AND MUSIC-PLAYING LAMP SYSTEM

BACKGROUND OF THE INVENTION

1. Field of the Invention

The present invention relates to a LOHAS product and more particularly, to a perfume-dispensing, auto light-regulating and music-playing lamp system, which simulates the lighting effect from dim to bright light of sun raise, releases a fragrant aroma to wake up the user at set time instead of ringing of an alarm clock, and playing natural sounds or music at set time.

2. Description of the Related Art

Following the step of LOHAS (Lifestyles of Health and Sustainability, a big amount of people try to choose organic foods, healthier foods, shop ethically and eco-friendly, use less resources, recycle almost everything, and take public transit. Through promotion of LOHAS lifestyle, people will discover that the idea of environmental friendly is just so simple and healthy organic food can be so tasty. A LOHAS consumer enjoys the happiness of simplicity. In Europe, America and Japan, the number of LOHAS consumers is increasing every year, and LOHAS markets are growing. In these countries, health food, environmental friendly buildings and furniture, recycled energy, second-hand products, electric bicycles, LOHAS electrical appliances, and yoga and spiritual uplifting programs are getting more and more popular.

The modern consumption tendency encourages the development of "consumption upgrade". Middle class consumers embrace new luxury goods they thought to be of higher quality and taste. The consumption pattern of trading up is spreading.

"LOHAS" is to enjoy living and to live happily. LOHAS people are not limited to rich people. LOHAS should not be equal to money. Rich persons or persons of leisure class may be not LOHAS people.

Trading up may simply get a transient happiness. Walking around a mountain, river, coast, fractal city or valley to enjoy the natural atmosphere simply let you forget secular affairs temporarily.

However, true LOHAS needs to upgrade your heart and mind nature and to maintain good living habits and a balanced diet. It emphasizes a balanced physical and mental development. Learning from nature and returning human nature are the keyways to enjoy LOHAS. Truth, goodness and patience are the nature of human life.

SUMMARY OF THE INVENTION

The present invention has been accomplished under the circumstances in view. It is one object of the present invention to provide a perfume-dispensing, auto light-regulating and music-playing lamp system, which is controllable to simulate the lighting effect from dim to bright light of sun raise, to change color tone, to release a pleasant smell at set time instead of ringing of an alarm clock, to output sound or play music at set time.

To achieve this and other objects of the present invention, the perfume-dispensing, auto light-regulating and music-playing lamp system comprises a body unit having a lamp mounted in a housing thereof, an aroma dispenser mounted in the body unit, a control panel mounted outside the body unit and having a function selector, a memory setting button and multiple display devices, and a speaker mounted in the body unit for sound/music output. The control panel comprises a function selector, an up-adjustment button, a down-adjustment button, an aroma button, a recording and playing button, an alarm button, a memory button, a snooze button, a quick check button, a sleep button, a LCD display panel, a lamp display, an emotional light display, a voice/music display, a FM display, an alarm clock display, and two speaker displays. By means of operating the function selector, a user can set on/off time of the lamp to simulate the lighting effect from dim to bright light of sun raise, to set alarm clock, to set on/off time of pre-recorded sound/music, and to set the aroma dispensing time of the aroma dispenser.

Further, the housing of the body unit comprises a bottom cover, a top cover, a first side cover, a second side cover, a first lampshade and a second lampshade. The lamp seat is affixed to the bottom cover to hold the lamp inside the body unit. The first and second side covers are fastened to left and right sides of the bottom cover. The bottom cover holds the control panel at the front side thereof. The back cover is affixed to the rear side of the bottom cover. The first and second lampshades are respectively coupled to the control panel and the back cover at the top side and connected between the first and second side covers.

Further, the display devices of the control panel include a LCD display panel, a lamp display, an emotional light display, a voice/music display, a FM display, an alarm clock display, and two speaker displays.

Further, the aroma dispenser comprises a box, fragrant means received in the box, and a fan disposed at one side of the box and adapted for causing currents of air to carrying the smell of the fragrant means to the outside of the body unit.

Further, the fragrant means can be solid fragrant agent, dry flowers, herb essence, flower essence, essential oil, essential wax, or perfume. Further, mint, jasmine, linden, lavender, rosemary, lemon verbena, or other dry herb leaves can be packed in a breathing bag and then set in the box.

Further, the perfume-dispensing, auto light-regulating and music-playing lamp system further comprises a circuit board for controlling power supply and executing all operation functions of the system.

Further, the lamp comprises color light emitting diodes controllable to provide different colors of light, giving a pleasant atmosphere.

Further, a multimedia player is installed in the body unit for recording a variety of sounds and music for reproduction under different emotional conditions.

Certain minutes before getting up, the perfume-dispensing, auto light-regulating and music-playing lamp system provides a lighting effect simulating sun raise from dim to bright light, changes the color tone of light for causing the user to change his (her) emotion, releases an aromatic smell, and/or playing natural sounds or music, thereby creating a warm and comfortable atmosphere. Thus, the user can wake up naturally in a warm color tone and music surrounding environment. This perfume-dispensing, auto light-regulating and music-playing lamp system wakes up the user smoothly without any piercing noises of an alarm clock. Therefore, the perfume-dispensing, auto light-regulating and music-playing lamp system is most suitable blind, deaf and dumb persons.

DETAILED DESCRIPTION OF THE PREFERRED EMBODIMENT

Figure 1:
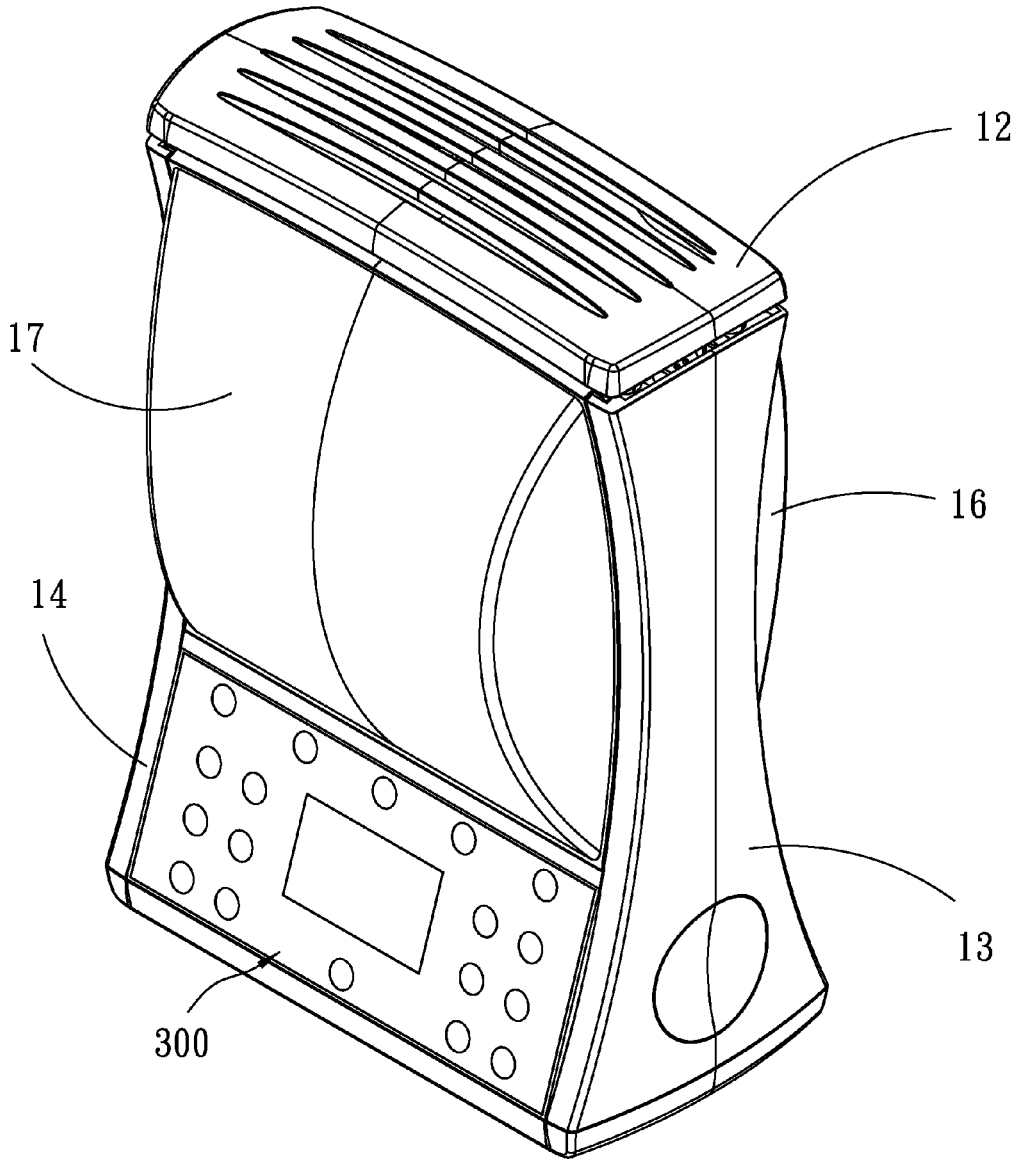
FIG. 1 is a front elevational view of a perfume-dispensing, auto light-regulating and music-playing lamp system in accordance with the present invention.
Figure 2:
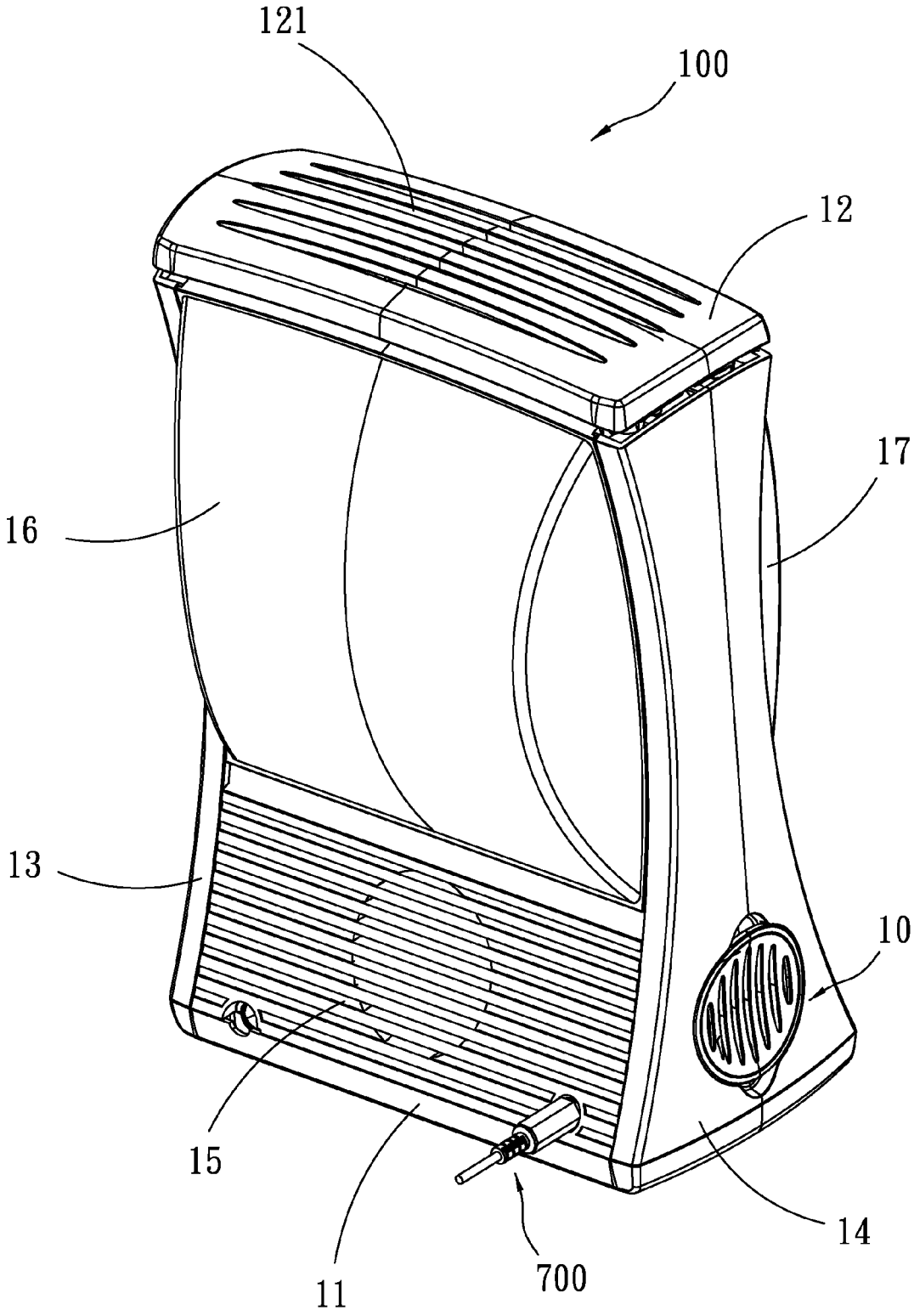
FIG. 2 is a rear elevational view of the perfume-dispensing, auto light-regulating and music-playing lamp system in accordance with the present invention.
Figure 3:
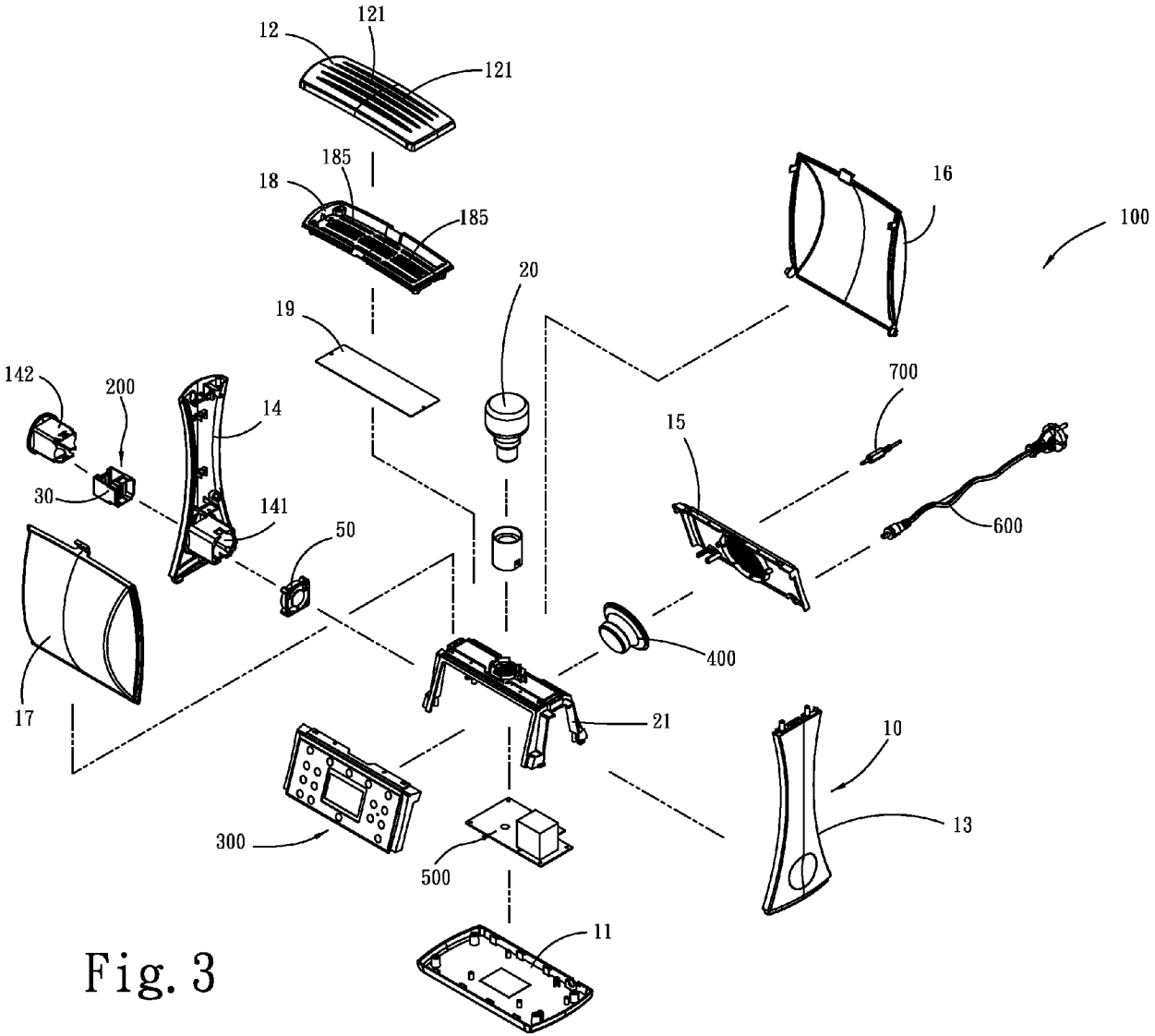
FIG. 3 is an exploded view of the perfume-dispensing, auto light-regulating and music-playing lamp system in accordance with the present invention.

Referring to FIGS. 1~3, a perfume-dispensing, auto light-regulating and music-playing lamp system in accordance with the present invention is shown comprising a body unit 100, an aroma dispenser 200, a control panel 300, a speaker 400, a circuit board 500 and a power cable 600.

The body unit 100 includes a housing 10 and a lamp 20. The housing 10 includes a bottom cover 11, a top cover 12, two side covers 13 and 14, a back cover 15, two lampshades 16 and 17, an inner cover 18, a thermal transfer plate 19, and a lamp seat 21. According to the present preferred embodiment, the lamp 20 is a light intensity micro-adjustable tungsten bulb that emits reddish/orange light. However, the lamp 20 can be a LED module comprising at least one LED (not shown). The lamp 20 is mounted in the lamp seat 21, and electrically connected to the circuit board 500. The top cover 12 has heat radiation holes 121 for quick dissipation of radiation heat from the lamp 20.

Figure 3A:
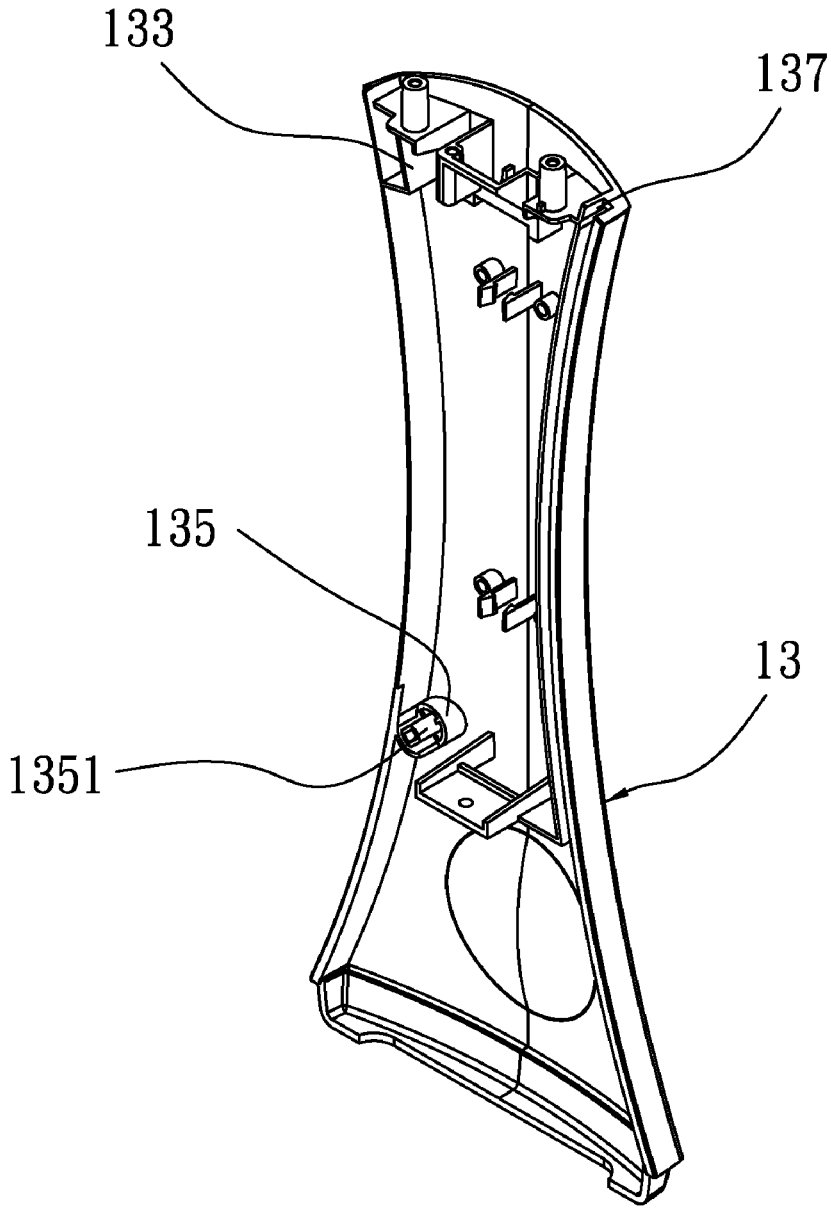
FIG. 3A is an oblique elevation of the first side cover according to the present invention.
Figure 3B:
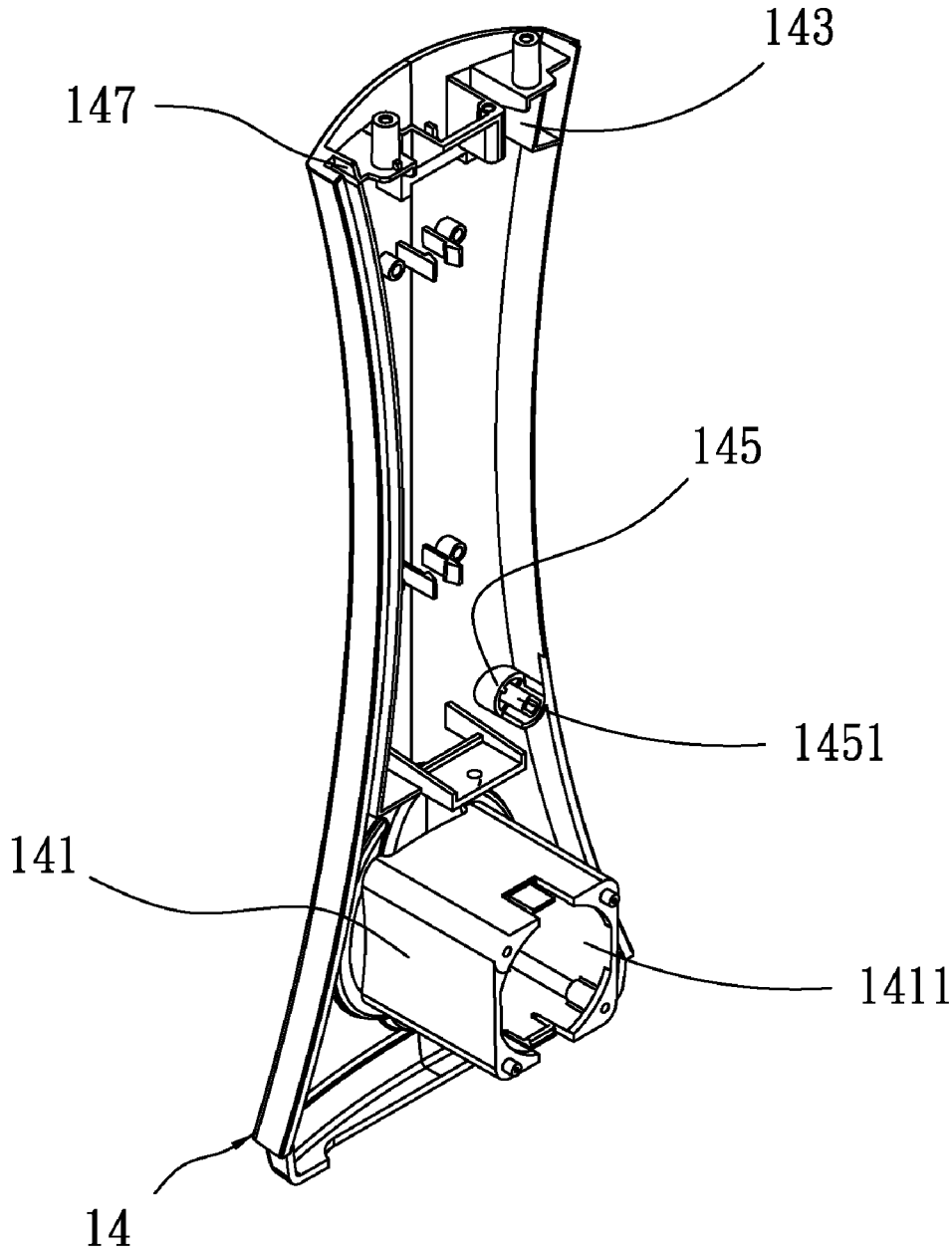
FIG. 3B is an oblique elevation of the second side cover according to the present invention.

Referring to FIGS. 3A and 3B, one side cover, namely, the first side cover 13 comprises a locating plate 133, a rotary seat 135, and a locating groove 137. The locating groove 137 extends along one lateral side of the first side cover 13. The locating plate 133 is a substantially L-shaped plate protruded from the inside wall of the first side cover 13 at one lateral side near the top. The rotary seat 135 is a hollow cylindrical member having a round pin 1351 axially located on the center. The other side cover, namely the second side cover 14 comprises a hollow shaft 141, a locating plate 143, a rotary seat 145, and a locating groove 147. The hollow shaft 141 defines therein a passage 1411. The locating plate 143 is a substantially L-shaped plate protruded from the inside wall of the second side cover 14 at one lateral side near the top. The rotary seat 145 is a hollow cylindrical member having a round pin 1451 axially located on the center.

Figure 3C:
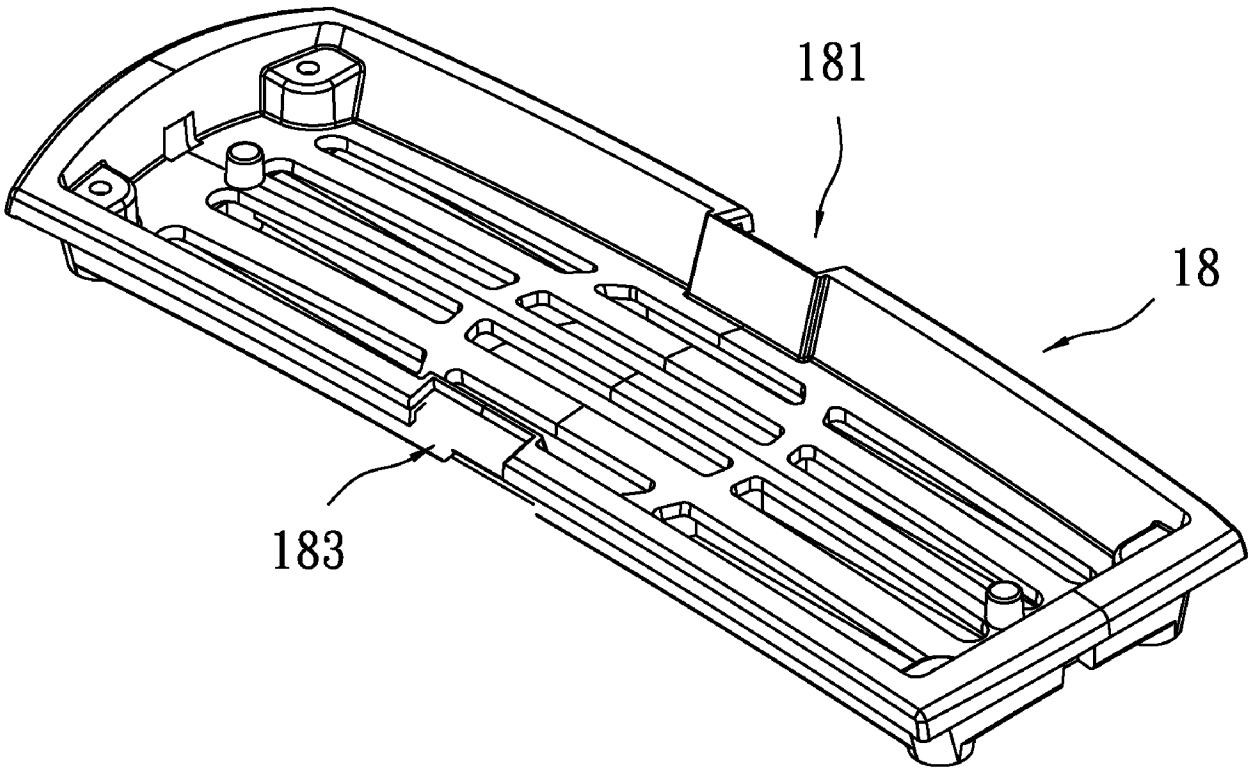
FIG. 3C is an oblique elevation of the inner cover according to the present invention.
Figure 3D:
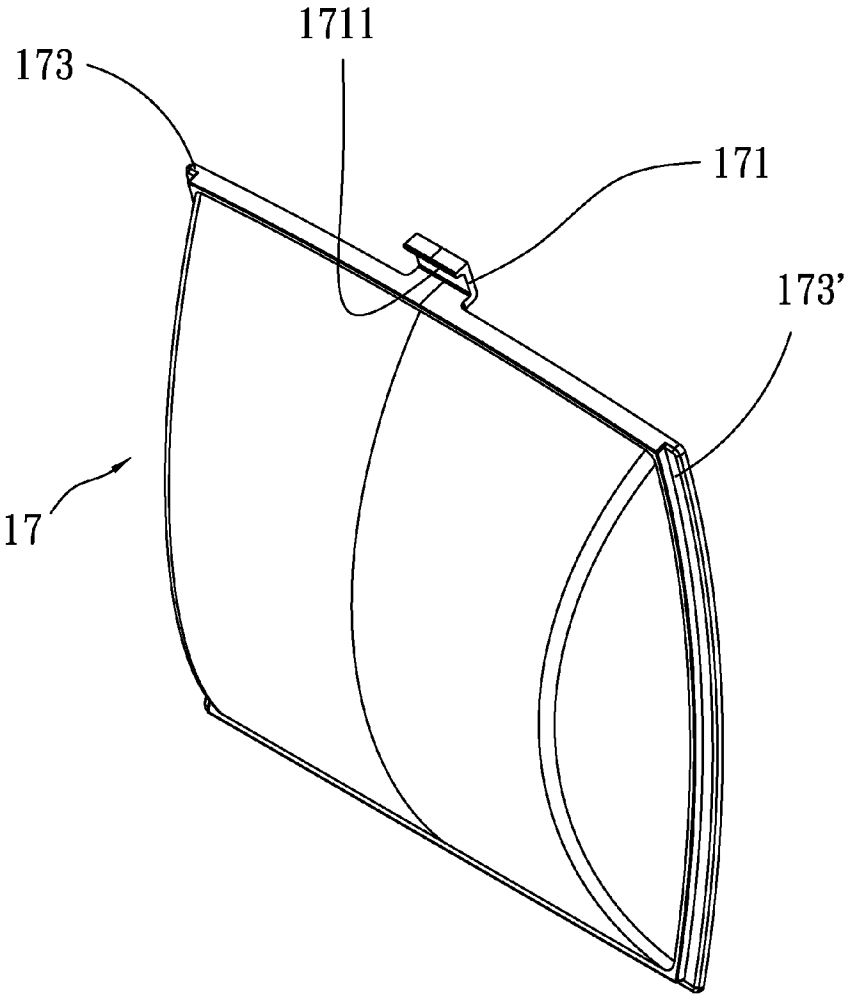
FIG. 3D is an oblique elevation of the first lampshade according to the present invention.
Figure 3E:
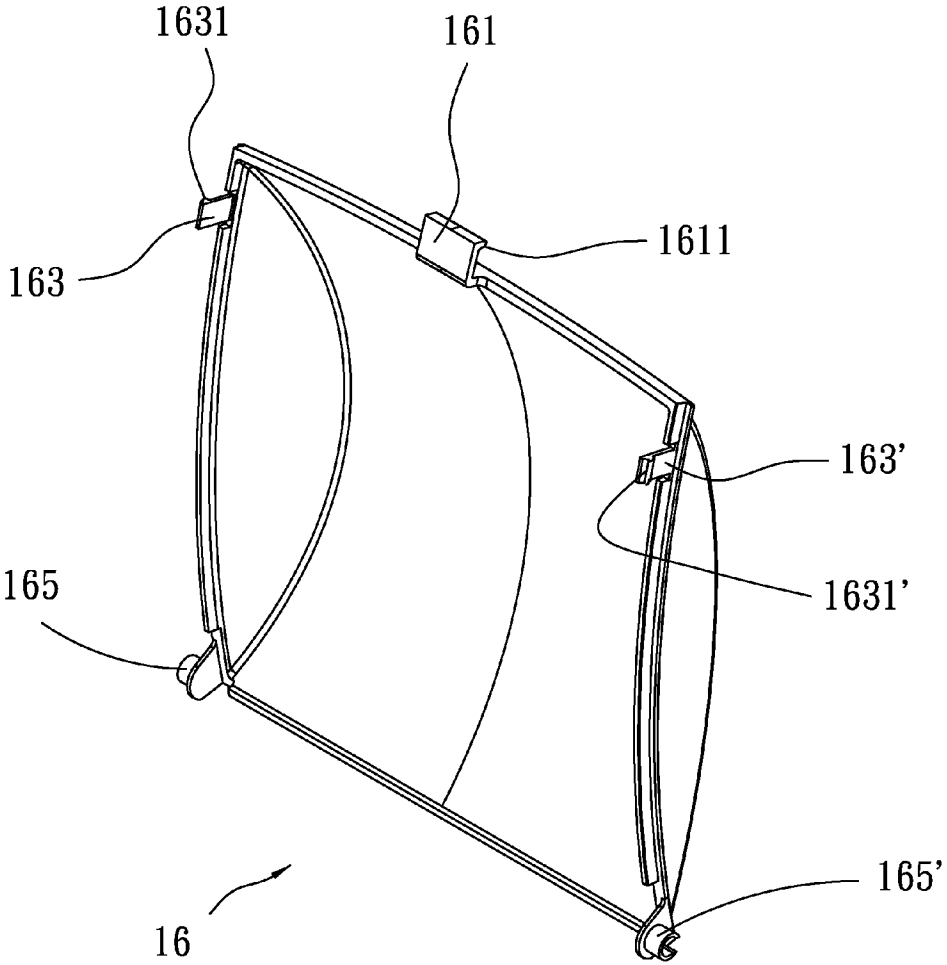
FIG. 3E is an oblique elevation of the second lampshade according to the present invention.

Referring to FIGS. 3C, 3D and 3E, the inner cover 18 has two locating grooves 181 and 183, and a plurality of radiation holes 185. One locating groove 181 is a rectangular groove located on one lateral side on the middle. The other locating groove 183 is a rectangular groove located on the other lateral side on the middle in a symmetric manner relative to the first locating groove 181. One lampshade, namely, the first lampshade 16 comprises a knob 161, two symmetrical retaining lugs 163 and 163', and two symmetrical pivot holders 165 and 165'. The pivot holders 165 and 165' are hollow cylindrical members respectively extended from two opposite lateral sides of the first lampshade 16 near the bottom, each having a C-shaped cross section. The knob 161 is a substantially C-shaped member extended from the top side of the first lampshade 16 on the middle, having a hooked portion 1611 at its free end. The retaining lugs 163 and 163' are respectively extended from two opposite lateral sides of the first lampshade 16 near the top and terminating in a hooked portion 1631 or 1631'. The other lampshade, namely, the second lampshade 17 comprises a knob 171, and two symmetrical sliding rails 173 and 173'. The knob 171 is a substantially C-shaped member extended from the top side of the second lampshade 17 on the middle, having a hooked portion 1711 at its free end. The two sliding rails 173 and 173' are symmetrically located on two opposite lateral sides of the second lampshade 17.

Figure 4:
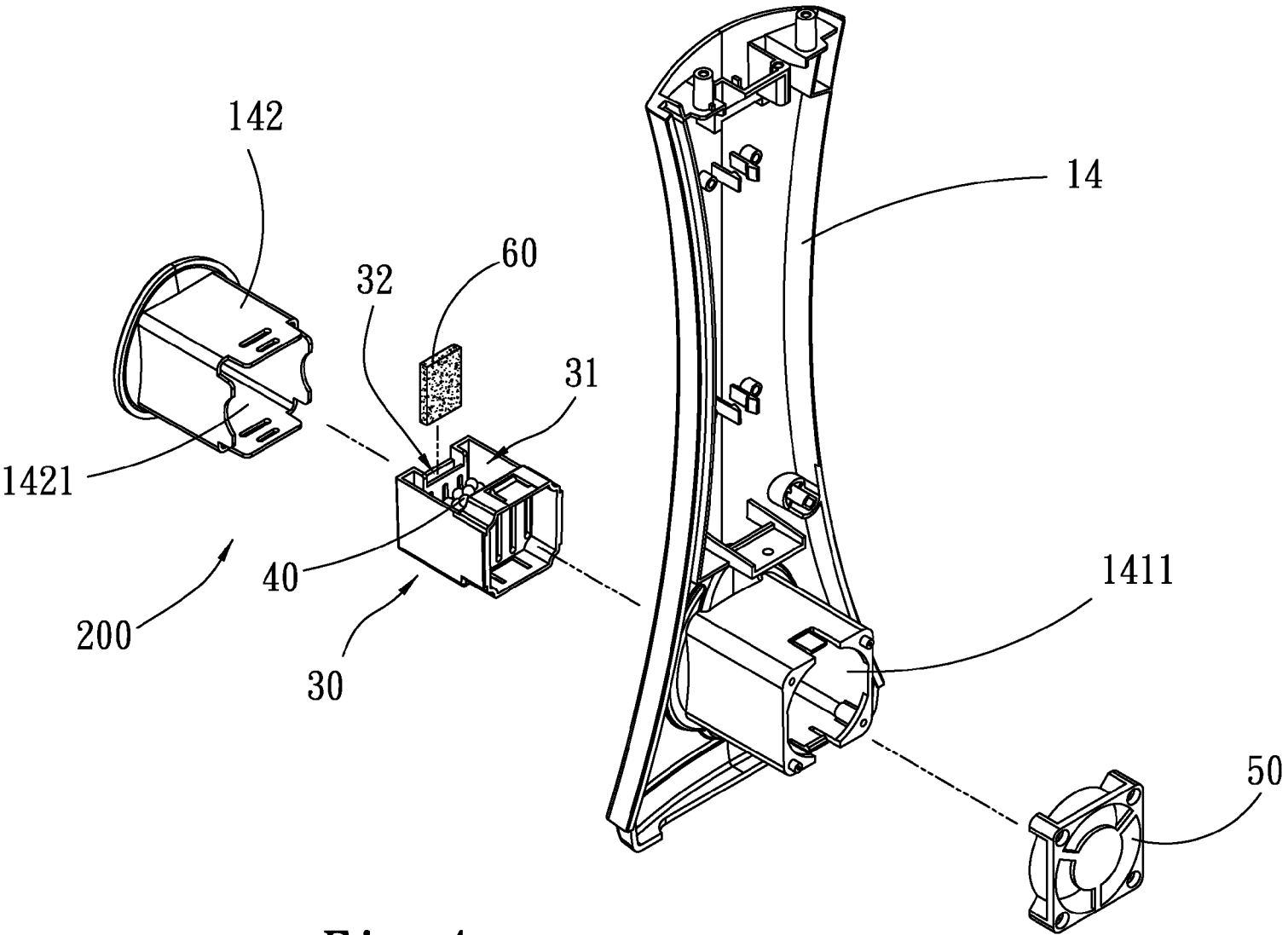
FIG. 4 is an exploded view of a part of the present invention, showing the structure of the aroma dispenser.

Referring to FIGS. 3 and 4, the aroma dispenser 200 comprises a box 30, a fragrant aroma 40, a fan 50, and a shell 142. The shell 142 defines therein an accommodation space 1421 adapted for accommodating the box 30. The fragrant aroma 40 is received in the box 30. The aroma dispenser 200 is set in the passage 1411 inside the hollow shaft 141 of the second side cover 14. The fan 50 is fastened to the hollow shaft 141 at one end of the passage 1411.

The aroma dispenser 200 further comprises a cotton pad 60. The box 30 defines therein a first compartment 31 and a second compartment 32 in communication with the first compartment 31. The fragrant aroma 40 is filled in the first compartment 31. The cotton pad 60 absorbs a liquid flavor, perfume or flower essence, and set in the second compartment 32. The fragrant aroma 40 can be a solid fragrant agent, herb essence, essential oil, essential wax or perfume. According to the present preferred embodiment, grained solid fragrant agent is used. Further, mint, jasmine, linden, lavender, rosemary, lemon verbena, or other dry herb leaves can be packed in a breathing bag and then set in the first compartment 31 of the box 30.

When the fan 50 is started, induced currents of air go through the fragrant aroma 40, carrying the pleasant smell from the fragrant aroma 40 through the passage 1411 to the outside of the housing 10.

Referring to FIGS. 3 and 3A~3E, insert the sliding rails 173, 173', 163 and 163' of the lampshades 17 and 16 into the locating grooves 147 and 137 to force the pivot holders 165 and 165 of the first lampshade 16 into coupling with the round pin 1451 of the rotary seat 145 and the round pin 1351 of the rotary seat 135. Thus, the first lampshade 16 can be turned about the round pins 1351 and 1451 relative to the side covers 13 and 14 between a close position and an open position. Further, a user can use a finger to pull the hooked portion 1611, thereby opening the first lampshade 16 and changing the lamp bulb. The hooked portions 1631 and 1631' of the retaining lugs 163 and 163' are respectively hooked on the locating plates 143 and 143 of the side covers 14 and 13. The inner cover 18 is capped on the top side of the side covers 14 and 13. The knob 161 of the first lampshade 16 is hooked on one locating groove 181 of the inner cover 18. The knob 171 of the second lampshade 17 is hooked on the other locating groove 181 of the inner cover 18. Thereafter, the top cover 12 is covered on the inner cover 18 and the lampshades 16 and 17 at the top side. Further, the side covers 14 and 13 have their bottom sides respectively fastened to the left and right sides of the lamp seat 21.

Figure 5:
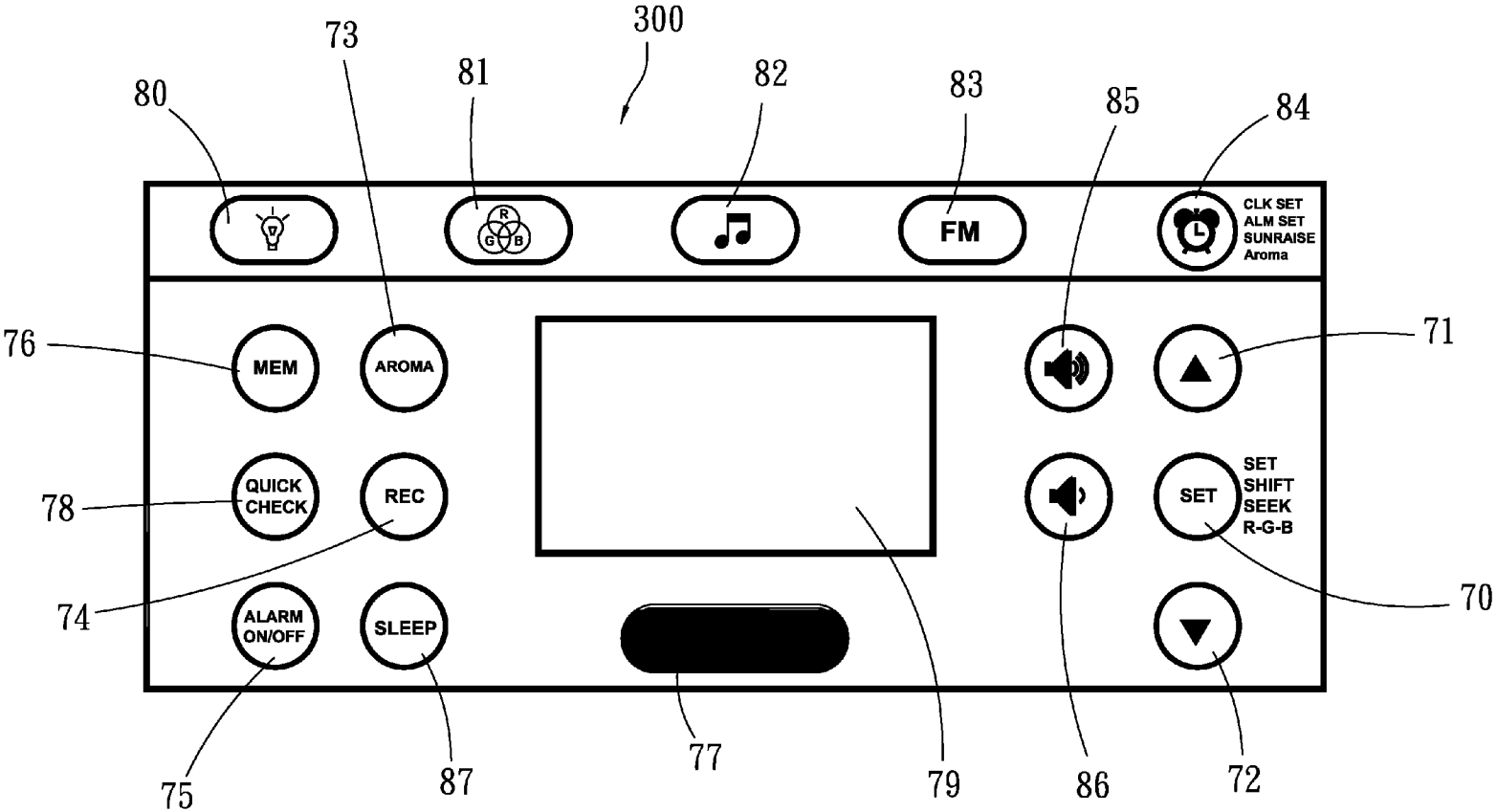
FIG. 5 is a front view of the control panel according to the present invention.

Referring to FIGS. 3 and 5, the control panel 300 is mounted on the outside of the housing 10 and fastened with its inner side to one side of the lamp seat 21. Further, the control panel 300 is electrically connected to the circuit board 500 for controlling the operation of the perfume-dispensing, auto light-regulating and music-playing lamp system. The control panel 300 comprises a function selector 70, an up-adjustment button 71, a down-adjustment button 72, an aroma button 73, a recording and playing button 74, an alarm button 75, a memory button 76, a snooze button 77, a quick check button 78, and a sleep button 87. The control panel 300 further comprises a LCD display panel 79, a lamp display 80, an emotional light display 81, a voice/music display 82, a FM display 83, an alarm clock display 84, and two speaker displays 85 and 86.

When the aforesaid snooze button 77 is pressed after the alarm clock alarmed once, the alarm clock will repeatedly alarm to wake up the person sleeping in after a predetermined time interval. When the quick check button 78 is clicked after the use of one or a number of functions, the system starts up the last function. When the sleep button 87 is clicked during the use of one of a number of functions, the function or functions in operation will be stopped at a predetermined time delay.

Referring to FIGS. 2 and 3 again, the speaker 400 is installed in the back cover 15 and then fastened with the back cover 15 to the other side of the lamp seat 21 opposite to the control panel 300. Thereafter, the bottom cover 11 is fastened to the side covers 13 and 14, the back cover 15 and the control panel 300 at the bottom side. Thus, the body unit 100 is completed. The speaker 400 is for output of pre-recorded sound or music.

Further, the perfume-dispensing, auto light-regulating and music-playing lamp system of the present invention further comprises a multimedia player 700 for recording a variety of sounds and music for reproduction under different emotional conditions.

The aforesaid thermal transfer plate 19 is mounted in the bottom side of the inner cover 18, and adapted for absorbing radiation heat for quick dissipation to the outside of the perfume-dispensing, auto light-regulating and music-playing lamp system through the radiation holes 185 of the inner cover 1 and the radiation holes 121 of the top cover 12.

Figure 6:
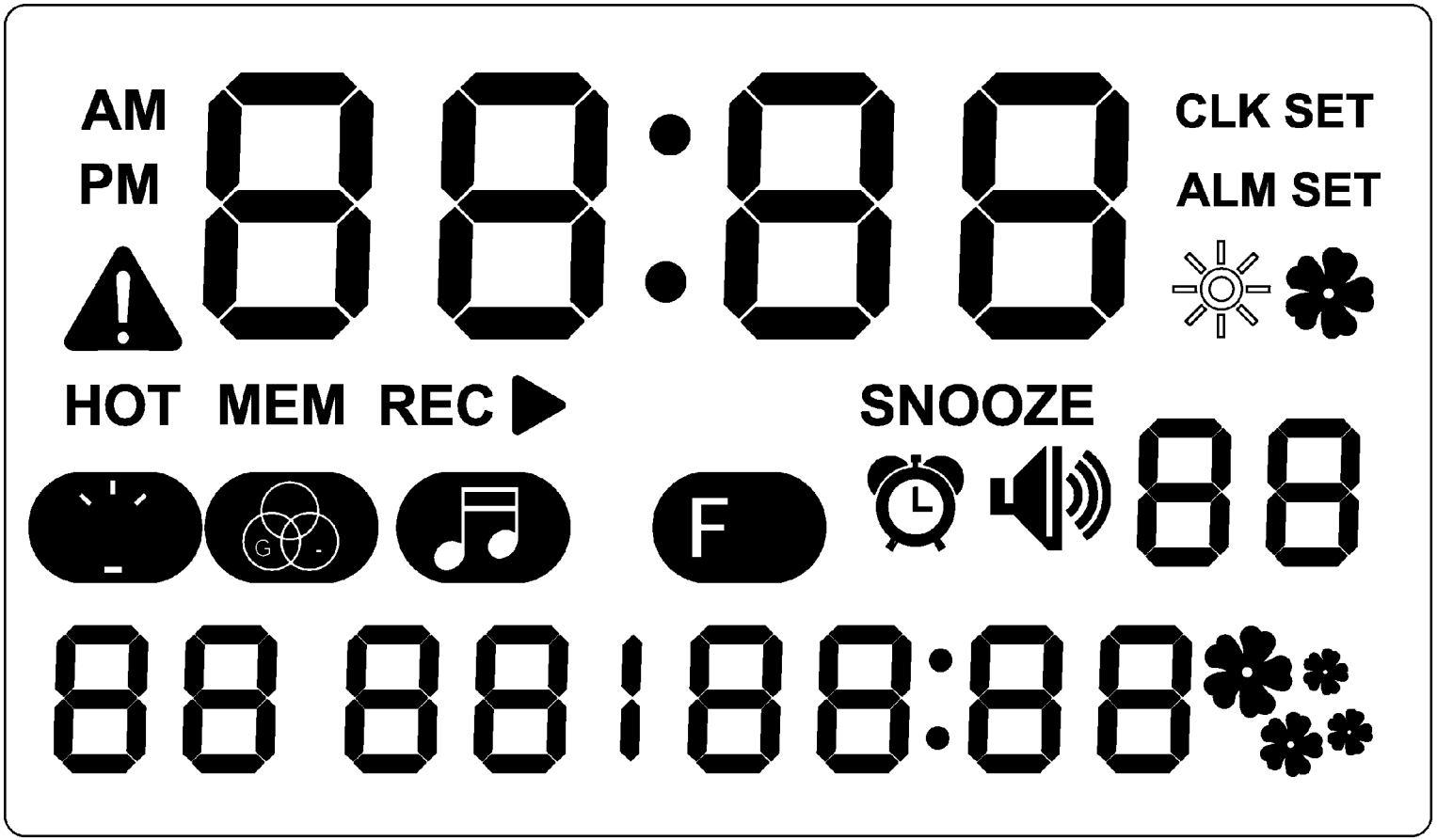
FIG. 6 is a front view of the LCD display device according to the present invention.

Referring to FIG. 6, the symbols shown in the LCD display panel 79 have the following meanings:

The symbol AM/FM 88:88 indicates before noon time, after noon time, or 24-hour clock time.

The symbol CLK SET is for time setting.

The symbol ALM SET is for alarm clock setting.

88 and Sun Raise symbols are for setting lighting brightness parameter, for example, 40, 45, 60 . . . and etc. When Alarm time is up, Sun Raise symbol is lightened, and the set parameter time starts to count down.

The symbol ❀ is setting automatic aroma function subject to set alarm time. When the automatic aroma function is set, the symbol is lightened.

The alarm clock and 188:88 symbols are for alarm setting. After ALARM setting, the alarm clock is lightened, and the set alarm time is displayed.

The lamp bulb, RGB and 88 symbols for LIGHT and RGB light emitting diode color tone indication. The two-digit 88 symbol indicates the brightness level of LIGHT from 1~25. RGB indicates 01~09 color tones. The maximum brightness of LIGHT is at the time when ALARM starts. RGB light emitting diode color tone is displayed through the emotional light display 81. By means of the application of modern technology, the perfume-dispensing, auto light-regulating and music-playing lamp system gives off different color tones of light to create different atmospheres for different conditions.

FM symbol and the aforesaid 188:88 symbol can be used for ALARM sound display.

Speaker and 88 symbols are for display sound volume.

The symbol MEM is for displaying ALARM setting value, and the intensity of music, radio or lamp.

The symbol REC is to indicate that the user can record a sound or music when the recording and playing button 74 is pressed and kept in the pressed condition, and the recorded sound or music will be automatically played for one time and then recorded in the music record. When reproduction is required, enter the music mode and replay the sound that can be, for example, a speech of a mother to a child, a sound of a mother to wake up a child, encourage words of a famous person for self-encouragement, or sweet words of a lover for morning call. The recording and playing button 74 can be used to record natural sounds, such as heart beat, sea wave sound, bird's whimpering, wind sound, sound of thunder, sound of rain, sound of church bells, sound of wind bells, sound of seagulls, sound of whale, baby crying sound, and any of a variety of natural sounds.

The symbol Hot is to indicate that the aroma dispenser timer fell down or the temperature is over high.

The symbol SNOOZE is to indicate that the aforesaid snooze button 77 has been pressed.

The symbol ❀❀❀❀ is to indicate that AROMA function has been started up.

As stated above, the perfume-dispensing, auto light-regulating and music-playing lamp system enables a user to operate the function selector 70 in setting the on/off time of the lamp 20. Certain minutes before getting up, the perfume-dispensing, auto light-regulating and music-playing lamp system provides a lighting effect simulating sun raise from dim to bright light, changes the color tone of light for causing the user to change his (her) emotion, releases an aromatic smell, and/or playing natural sounds or music, thereby creating a warm and comfortable atmosphere. Thus, the user can wake up naturally in a warm color tone and music surrounding environment. This perfume-dispensing, auto light-regulating and music-playing lamp system wakes up the user smoothly without any piercing noises of an alarm clock. Therefore, the perfume-dispensing, auto light-regulating and music-playing lamp system is most suitable blind, deaf and dumb persons. Further, the fan 50 can be controlled by a timer to cause currents of air for carrying the pleasant smell of the fragrant aroma 40 and the liquid perfume in the cotton pad 60 to the outside of the system, freshening the whole space of the house. By means of releasing a fragrant smell to wake up the user instead of the noise of an alarm block, the user wakes naturally to start every vigorous day.

Further, the recording and playing button 74 can be used to record natural sounds, such as bird's whimpering, or radio music for output through the speaker to wake up the user peacefully without piercing noises, so that the user can start each day under in good lifestyle.

The perfume-dispensing, auto light-regulating and music-playing lamp system is most suitable blind, deaf and dumb persons. By means of a fragrant smell, soft natural music, or dim to bright light of sun raise simulating lighting effect, the system wakes up a blind person or deaf and dumb person comfortably.

A prototype of perfume-dispensing, auto light-regulating and music-playing lamp system has been constructed with the features of FIGS. 1~6. The perfume-dispensing, auto light-regulating and music-playing lamp system functions smoothly to provide all of the features disclosed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A perfume-dispensing, auto light-regulating and music-playing lamp system, comprising:

a body unit, said body unit comprising a housing and a lamp mounted inside said housing;

an aroma dispenser mounted inside said body unit;

a control panel mounted on the outside of said body unit, said control panel comprising a function selector, an aroma button, a recording and playing button, an alarm button, a memory button, and a plurality of display devices; and a speaker mounted in said body unit for output of pre-recorded sound and music;

wherein said function selector is operable to set on/off time of said lamp so as to simulate the lighting effect from dim to bright light of sun raise, to set alarm clock, to set on/off time of pre-recorded sound/music, and to set the aroma dispensing time of the aroma dispenser, and wherein said housing of said body unit comprises a bottom cover, a top cover, a first side cover, a second side cover, a first lampshade and a second lampshade, a lamp seat being affixed to said bottom cover to hold said lamp inside said body unit, said first and second side covers being fastened to left and right sides of said bottom cover, said bottom cover holding said control panel at a front side thereof, a back cover being affixed to a rear side of said bottom cover, said first and second lampshades being respectively fastened to said control panel and said back cover at a top side and connected between said first and second side covers.

2. The perfume-dispensing, auto light-regulating and music-playing lamp system as claimed in claim 1, wherein said first side cover comprises a rotary seat, and a locating groove extending along one lateral side of said first side cover, a substantially L-shaped plate protruded from an inside wall at one lateral side near a top side of said first side cover, and a rotary seat being a hollow cylindrical member having a round pin axially located on the center thereof; said second side cover comprises a hollow shaft defining therein a passage, a substantially L-shaped plate protruded from an inside wall at one lateral side near a top side of said second side cover, and a rotary seat being a hollow cylindrical member having a round pin axially located on the center thereof.

3. The perfume-dispensing, auto light-regulating and music-playing lamp system as claimed in claim 1, wherein an inner cover comprises a first rectangular groove located on one lateral side thereof on the middle, a second rectangular groove located on an opposite lateral side thereof on the middle in a symmetric manner relative to said first locating groove, and a plurality of radiation holes; said second lampshade comprises two hollow cylindrical pivot holders respectively extended from two opposite lateral sides thereof at a bottom side and having each a C-shaped cross section, a substantially C-shaped member knob extended from a top side thereof on the middle and terminating in a hooked portion, and two retaining lugs respectively extended from two opposite lateral sides of said second lampshade at a top side and respectively terminating in a hooked portion; said first lampshade comprises a substantially C-shaped knob extended from a top side thereof on the middle and terminating in a hooked portion, and two sliding rails symmetrically located on two opposite lateral sides thereof and respectively coupled to the locating grooves of said first and second side covers.

4. The perfume-dispensing, auto light-regulating and music-playing lamp system as claimed in claim 3, further comprising a thermal transfer plate mounted in a bottom side of said inner cover.

5. The perfume-dispensing, auto light-regulating and music-playing lamp system as claimed in claim 1, wherein said control panel further comprises an up-adjustment button, a down-adjustment button, a snooze button, a quick check button, and a sleep button.

6. The perfume-dispensing, auto light-regulating and music-playing lamp system as claimed in claim 5, wherein said control panel further comprises a LCD display panel, a lamp display, an emotional light display, a voice/music display, a FM display, an alarm clock display, and two speaker displays.

7. The perfume-dispensing, auto light-regulating and music-playing lamp system as claimed in claim 1, wherein said aroma dispenser comprises a box, fragrant means received in said box, and a fan disposed at one side of said box and adapted for causing currents of air to carrying the smell of said fragrant means to the outside of said body unit.

8. The perfume-dispensing, auto light-regulating and music-playing lamp system as claimed in claim 7, wherein said aroma dispenser further comprises a cotton pad; said box comprises a first compartment receiving said fragrant means, and a second compartment receiving said cotton pad and disposed in communication with said first compartment.

9. The perfume-dispensing, auto light-regulating and music-playing lamp system as claimed in claim 1, wherein said fragrant means comprises at least one of solid fragrant agent, dry flowers, herb essence, flower essence, essential oil, essential wax and perfume.

10. The perfume-dispensing, auto light-regulating and music-playing lamp system as claimed in claim 1, wherein said lamp comprises at least one of tungsten lamp bulbs and light emitting diodes.

* * * * *